United States Patent [19]

Nakanishi

[11] Patent Number: 4,658,471

[45] Date of Patent: Apr. 21, 1987

[54] HINGE WITH NO TUBULAR PORTION AND METHOD OF PRODUCING THE SAME

[75] Inventor: Yoshiaki Nakanishi, Nara, Japan

[73] Assignee: Kitamura Iron Works, Ltd., Osaka, Japan

[21] Appl. No.: 804,300

[22] Filed: Dec. 3, 1985

[30] Foreign Application Priority Data

Dec. 28, 1984 [JP] Japan ..... 59-280066

[51] Int. Cl.[4] ..... E05D 7/00

[52] U.S. Cl. ..... 16/224; 16/275; 16/386; 16/387; 16/DIG. 13; 29/11

[58] Field of Search ..... 16/224, 275, 385, 386, 16/387, 225, DIG. 13; 29/11

[56] References Cited

U.S. PATENT DOCUMENTS

| | | | |
|---|---|---|---|
| 2,569,862 | 10/1951 | Morin | 16/386 |
| 2,624,907 | 1/1953 | Graham | 29/11 |
| 3,000,049 | 9/1961 | Terry, Jr. | 16/386 |

FOREIGN PATENT DOCUMENTS

| | | | |
|---|---|---|---|
| 2916560 | 11/1980 | Fed. Rep. of Germany | 29/11 |
| 121775 | 12/1918 | United Kingdom . | |
| 232547 | 1/1926 | United Kingdom | 16/224 |
| 619636 | 3/1949 | United Kingdom | 16/224 |
| 1014697 | 12/1965 | United Kingdom | 16/385 |
| 1144675 | 3/1969 | United Kingdom | 16/224 |
| 1352683 | 5/1974 | United Kingdom . | |
| 2001399 | 1/1979 | United Kingdom . | |

*Primary Examiner*—Leonidas Vlachos

*Attorney, Agent, or Firm*—Trexler, Bushnell & Wolters, Ltd.

[57] ABSTRACT

A hinge with a left-hand side flap plate and a right-hand side flap plate, each of which has no tubular portion for receiving a shaft bar. Each side flap plate has on its end at least one shaft plate having at least one communication hole and at least one semicircular locking hole. The semicircular holes come in contact with each other to form a circular portion when the shaft plates of the right and left flap plates are fitted together. In this circular portion a ball having a washer is fitted. The shaft plates, communication holes and the ball are covered with core shafts communicating with the opposite surface of the shaft plates. The core shafts are made of synthetic resin or die casting alloy.

7 Claims, 8 Drawing Figures

HINGE WITH NO TUBULAR PORTION AND METHOD OF PRODUCING THE SAME

BACKGROUND OF THE INVENTION

The present invention relates to a hinge used by being mounted on an opening and closing connection, such as a door, and a method of producing the same, and more particularly it relates to a hinge with no tubular portion for receiving a shaft bar, and a method of producing the same.

A conventional hinge used by being mounted on an opening and closing section, such as a door, comprises two flap plates curled at one of their respective lateral ends to form tubular portions, a shaft bar inserted in the two tubular portions to hold them for turning movement thereon, legs force-fitted into the open ends of the two tubular portions to prevent the shaft bar from falling off, and a flat head knob fixed in position. In some hinges, a ring made of a synthetic resin, such as nylon, which ensures smooth slide movement and little wear is externally fitted between the two tubular portions.

In this type of hinges, since the two flap plates are formed at one of their respective lateral ends with tubular portions, the number of steps for producing the two flap plates is correspondingly increased and hence the processing cost is high. Particularly in a large-sized hinge, the material for flap plates has an increased thickness and hence is harder to process and takes a longer processing time, resulting in a high cost. Further, there is a drawback that during a long time of use of the hinge, the flat head knob can wear out to cause the shaft bar to slip off, leading to damage to the hinge and door. In some types, to prevent the shaft bar from slipping off, the flat head knob is welded to the tubular portion or otherwise fixed by inserting a pin therein laterally of the tubular portion, but these types are hard to produce, leading to an increase in cost.

The present invention, which has been accomplished in view of these problems in the prior art, has for its object the provision of a hinge of epoch-making construction wherein contrary to the conventional technical concept there is no curled tubular portion and hence no shaft bar is used.

Another object of the present invention is to provide a method of producing the aforesaid hinge.

A hinge according to the present invention comprises a left-hand side flap plate having on its right-hand end at least one shaft plate having at least one communication hole and at least one semicircular locking hole, a right-hand side flap plate having on its left-hand end at least one shaft plate having at least one communication hole and at least one semicircular locking hole, said semicircular locking holes coming in contact with each other to form a circular portion when the shaft plates of said left-hand and right-hand side flap plates are fitted together, a ball fitted in said circular portion and having a washer fitted thereon, and core shafts communicating with the opposite surfaces of the shaft plates through said communication holes and separated from each other by said washer.

Further, a method of producing the hinge according to the invention comprises the steps of fabricating a left-hand side flap plate having on its right-hand end at least one shaft plate having at least one communication hole and at least one semicircular locking hole and a right-hand side flap plate having on its left-hand end at least shaft plate having at least one communication hole and at least one semicircular locking hole, fitting the shaft plates of said left-hand and right-hand side flap plates together to thereby cause said semicircular locking holes to form a circular portion, fitting in said circular portion a ball having a washer fitted thereon, and forming core shafts communicating with the opposite surfaces of the shaft plates through said communication holes.

The core shafts are preferably formed by injection molding a synthetic resin, such as polyamide, polyacetal or polyester or by casting a die casting alloy, such as an aluminum alloy or zinc alloy.

Further, the shaft plate portions extend preferably in uneven parallel relation to the flap plates.

Since the hinge according to the invention uses no flap plate having a tubular portion as in the conventional hinge, the right and left flap plates are very easy to fabricate and the number of processing steps is correspondingly reduced. Further, since there is no need for the difficult operation of fixing a head knob at the open end of the tubular portion to prevent the shaft bar from slipping off as in the conventional hinge, the assembly operation is very easy.

Further, since the hinge according to the invention turns through the washer mounted on the ball, the opening and closing operation thereof is very smooth, and since the load is imposed on the washer through the core shafts, there is no danger of producing localized load.

The invention will be described in more detail with reference to the accompanying drawings showing an embodiment thereof.

DESCRIPTION OF THE PREFERRED EMBODIMENTS

Figure 1:
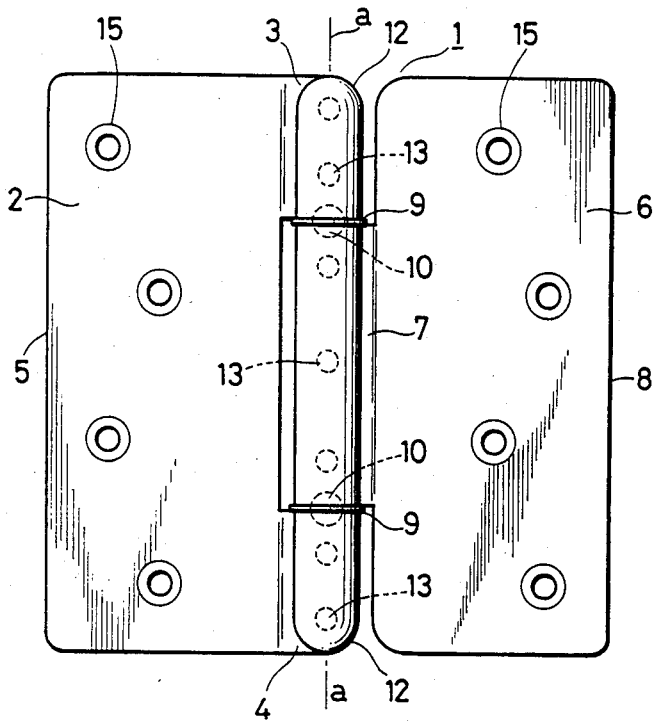
FIG. 1 is a front view of a hinge according to an embodiment of the invention.
Figure 2:
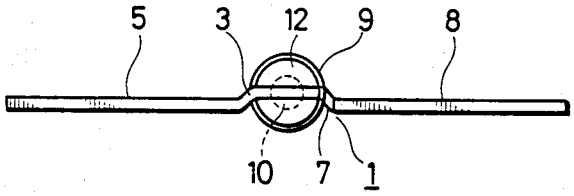
FIG. 2 is a plan view of the hinge of said embodiment.

The hinge 1 of the invention has left-hand and right-hand side flap plates 5 and 8. The left-hand side flap plate 5 has upper and lower shaft plates 3 and 4 of predetermined length disposed on one lateral end of a left-hand flap plate body 2. As is clear from FIG. 2, these shaft plates 3 and 4 are formed by slightly bending the upper and lower portions of one lateral end of the left-hand side flap plate body 2 so that they extend in uneven parallel relation to the left-hand side flap body 2. Further, the right-hand side flap plate 8 has a central shaft plate 7 of predetermined length disposed on one lateral end of a right-hand side flap plate body 6. The central shaft plate 7 is formed by slightly bending the central portion of the right-hand side flap plate body 6 so that it extends in uneven parallel relation to the right-hand side flap plate body 6. The length of the central shaft plate 7 of the right-hand side flap plate body 8 is such that it fits between the upper and lower shaft plates 3 and 4 of the left-hand side flap plate 5.

Figure 3:
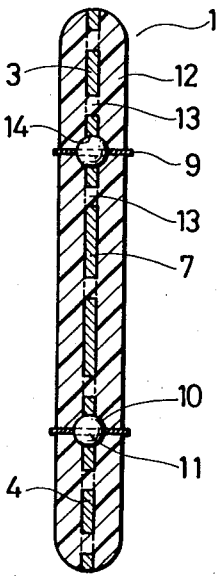
FIG. 3 is a sectional view taken along the line a—a in FIG. 1.

Washers 9 of predetermined thickness are inserted between the central shaft plate 7 and the upper and lower shaft plates 3 and 4. The washers 9 are made of metal, such as steel or stainless steel, and, as shown in FIG. 3, each has a throughgoing hole 11 for receiving a steel ball 10 therein. It is core shafts 12 that hold the balls 10 on the upper and lower sides of the washers 9, said core shafts being aligned with the axis a—a of the shaft plates 3, 4 and 7. The core shafts 12 are made of a synthetic resin, such as polyamide, polyacetal or polyester, or a die casting alloy, such as an aluminum alloy or zinc alloy, and are cylindrically formed on both surfaces of the shaft plates 3, 4 and 7 so that they project therefrom. To increase the strength of the core shafts 12, a plurality of communication holes 13 are formed in the shaft plates 3, 4 and 7 so that they are suitably spaced on the axis a—a of the shaft plates and the synthetic resin or die casting alloy communicates with both surfaces of the shaft plates 3, 4 and 7 through said communication holes 13.

The respective connecting ends of the shaft plates 3, 4 and 7 are formed with semicircular locating recesses 14, and the balls 10 will be received when the upper and lower ends are put together to form a circular portion.

The hinge 1, when used, is fixed to a pillar and a door by screws extending through screw holes 15.

Figure 4:
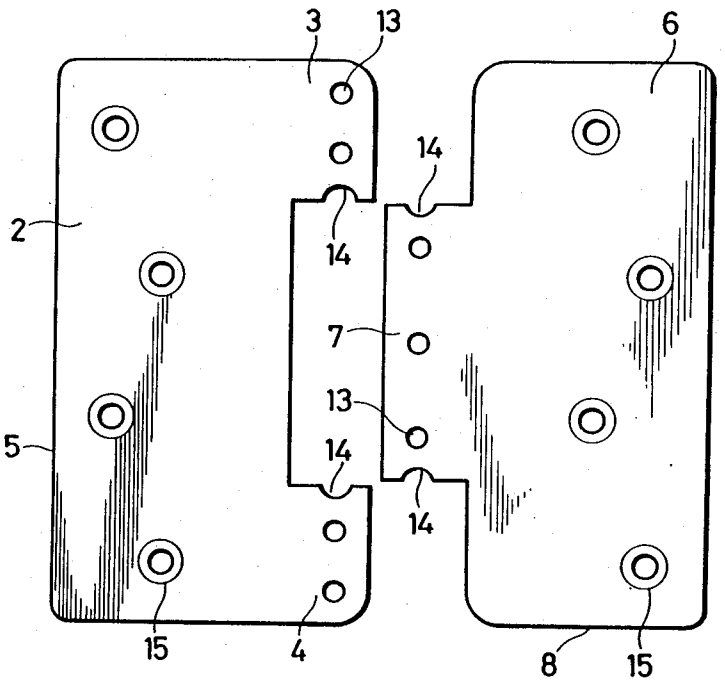
FIGS. 4–8 are schematic assembly system views for explaining the hinge producing method according to the invention.

The method of producing this hinge 1 will now be described with reference to FIG. 4. First, a brass, steel, stainless steel or other metal plate is punched to produce the planar left-hand side flap plate 5 or the planar right-hand side flap plate 8 wherein the upper and lower shaft plates 3 and 4 or the central shaft plate 7 are formed with a plurality of communication holes 13 and locating recesses 14 disposed on the axis a—a thereof and the flap plate body 2 or 6 is formed with a plurality of screw holes 15 (FIG. 4).

Figure 6:
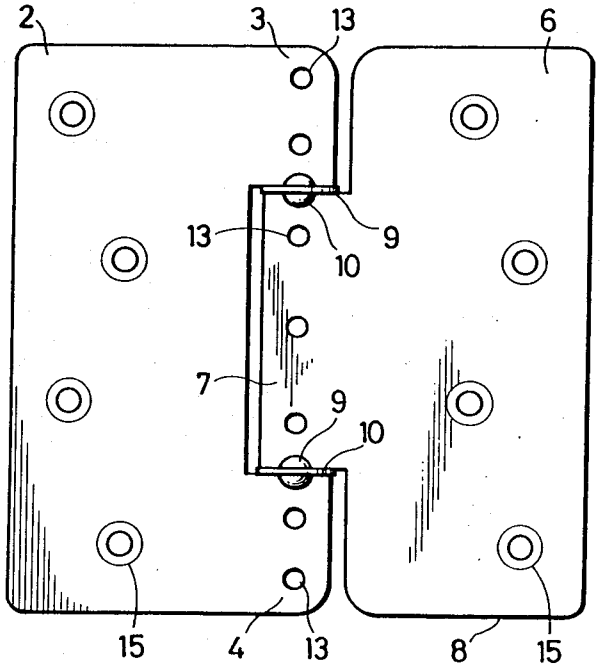
Figure 5:
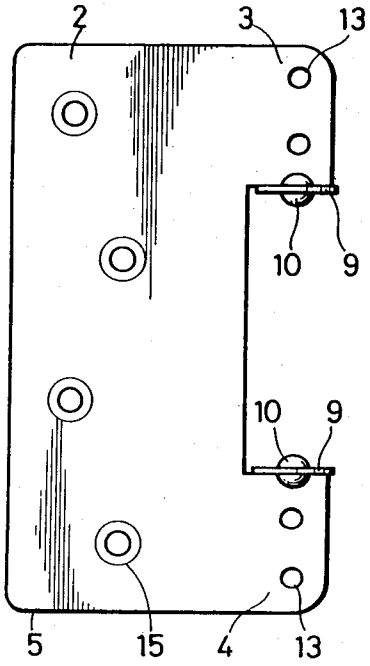

Subsequently, the left-hand side flap plate 5 is placed at a predetermined position in a lower mold half for resin molding and balls 10 having washers 9 fitted thereon are fitted in the locating recesses 14 of the upper and lower shaft plates 3 and 4 (FIG. 5). Thereafter, the central shaft plate 7 is positioned so that the upper and lower balls 10 are fitted in the locating recesses 14 of the central shaft plate 7 (FIG. 6), and then the upper mold half is fitted to the lower mold half.

Figure 7:
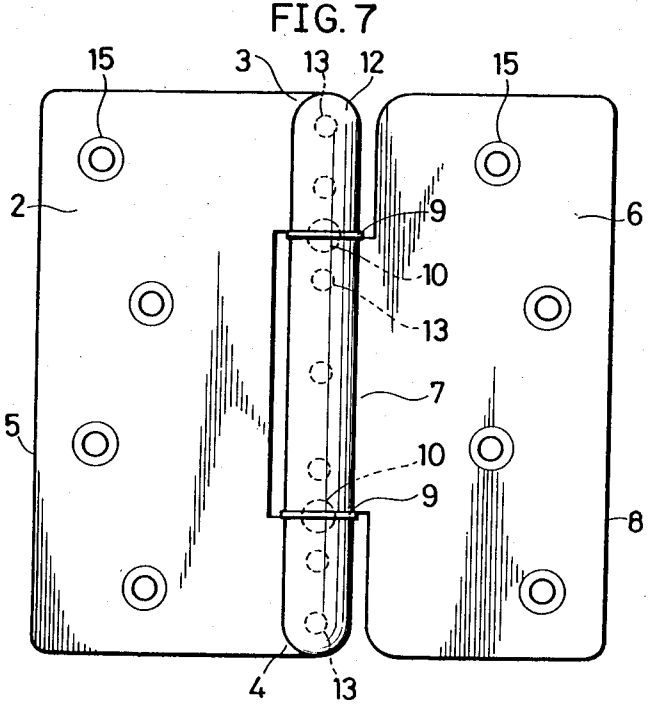

After the left-hand and right-hand side flap plates 5 and 8, washers 9 and balls 10 have been installed, a synthetic resin, such as polyamide, polyacetal or polyester, is injection-molded or a die casting alloy, such as an aluminum alloy or zinc alloy, is cast to form the core shafts 12 of synthetic resin or die casting alloy on both surfaces of the shaft portions 3, 4 and 7 of the flap plates, whereupon the molding is removed from the mold (FIG. 7).

Figure 8:
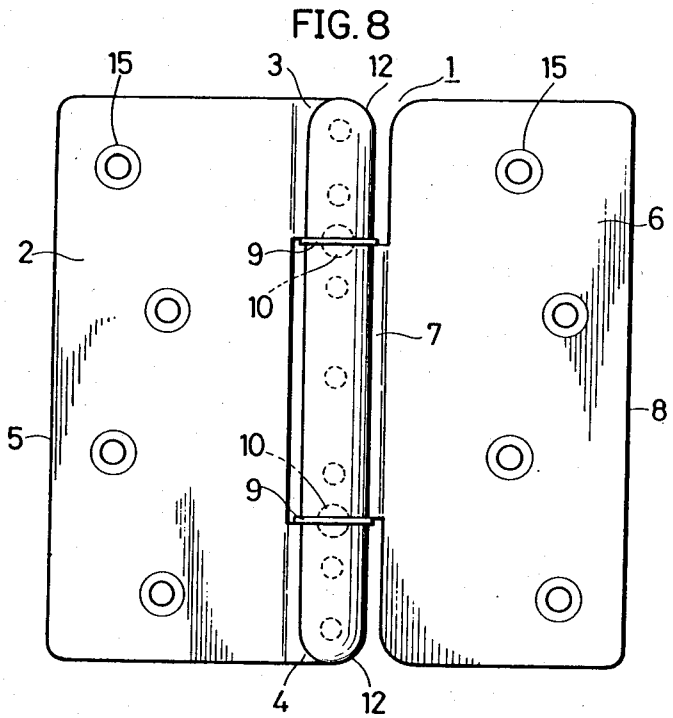

Subsequently, the bases of the shaft portions 3, 4 and 7 of the flap plates are bent by press work to form the shaft plates, thereby completing the hinge 1 (FIG. 8).

In the hinge 1 according to the present invention, since the balls 10 fitted in the locating recesses 14 are fixed by the core shafts 12, the two flap plates 5 and 8 turn relative to each other on both sides of the washers 9 without the possibility of coming off.

In this case, the two flap plates 5 and 8 used in the hinge 1 do not require tubular portions as in the conventional flap plates and instead it is only necessary to punch the two flap plates 5 and 8 out of a flat material and then bend the bases of the shaft plates 3, 4 and 7; thus, the manufacture is very easy and the number of processing steps is greatly reduced. The conventional hinge requires 3 or more processing steps and if the thickness of the plate to be processed is increased, the processing becomes very difficult, but the hinge of the present invention can be produced in one processing step. Further, unlike the conventional hinge, the present hinge does not need the troublesome operation of fixing a head knob at the open end of the tubular portion to prevent the shaft bar from slipping off and can be assembled by simply fitting the washers 9 and balls 10 in the mutually contacted locating recesses 14 of the shaft plates 3, 4 and 7 and then injection molding a synthetic resin or casting a die casting alloy to thereby form the core shafts 12; thus, the assembly operation is very easy.

Further, since the hinge 1 according to the present invention turns through the washers 9 mounted on the balls 10, its opening and closing operation is very smooth, and since the load is imposed on the washer 9 through the cylindrical core shafts 12, there is no danger of producing localized load. Moreover, where a synthetic resin is used for the core shafts 12, since the core shafts 12 make slide contact with the washers 9 formed of steel plate, the life is very long. Further, if synthetic resins of various colors are used, hinges of various colors can be provided, stimulating the desire of buying.

In the embodiment described above, the shaft plates 3, 4 and 7 are formed by bending their bases after the formation of the core shafts 12, but two flap plates having the bases of the shaft portions 3, 4 and 7 bent in advance may be used or, depending how the hinge is used flat plates as such with no bend may be used to form a hinge. Bending the shaft portions is advantageous in that the right and left flap plate bodies of the hinge can be superposed. Further, although the core shafts 12 are cylindrically formed, they may not be cylindrical provided that the balls 10 can be positively held thereby. Further, the washers 9 are used one for each ball, but two washers may be used for each ball without spoiling their function. Further, the hinge 1 having three shaft plates 3, 4 and 7 which are fitted together has been described, a similar arrangement may be applied to a hinge having two, four or five shaft plates.

What is claimed is:

1. A hinge with no tubular portion comprising:

a left-hand side flap plate having on its right-hand end at least one shaft plate having at least one communication hole and at least one semicircular locking recess, a right-hand side flap plate having on its left-hand end at least one shaft plate having at least one communication hole and at least one semicircular locking recess, said semicircular locating recesses coming in contact with each other to form a circular portion when the shaft plates of said right and left flap plates are fitted together, a ball having a washer fitted thereon, adapted to fit in said circular portion, and core shafts communicating with the opposite surfaces of the shaft plates through said communication holes and separated from each other by said washer.

2. A hinge with no tubular portion as set forth in claim 1, wherein said shaft plates extend in uneven parallel relation to the flap plate bodies.

3. A hinge with no tubular portion as set forth in claim 1 or 2, wherein said core shafts are made of synthetic resin.

4. A hinge with no tubular portion as set forth in claim 1 or 2, wherein said core shafts are made of die casting alloy.

5. A method of producing a hinge with no tubular portion, comprising the steps of:

fabricating a left-hand side flap plate having on its right-hand end at least one shaft plate having at least one communication hole and at least one semicircular locating recess and a right-hand side flap plate having on its left-hand end at least one shaft plate having at least one communication hole and at least one semicircular locating recess, fitting the shaft plates of said left-hand and right-hand side flap plates together to thereby cause said semicircular locking recesses to form a circular portion, fitting in said circular portion a ball having a washer fitted thereon, and forming core shafts communicating with the opposite surfaces of the shaft plates through said communication holes.

6. A method of producing a hinge with no tubular portion as set forth in claim 5, wherein the core shafts are formed by injection molding synthetic resin.

7. A method of producing a hinge with no tubular portion as set forth in claim 5, wherein the core shafts are formed by casting a die casting alloy.

* * * * *